US008073349B2

(12) United States Patent
Zaima

(10) Patent No.: US 8,073,349 B2
(45) Date of Patent: Dec. 6, 2011

(54) IMAGE FORMING APPARATUS

(75) Inventor: Nobuhiko Zaima, Abiko (JP)

(73) Assignee: Canon Kabushiki Kaisha (JP)

( * ) Notice: Subject to any disclaimer, the term of this patent is extended or adjusted under 35 U.S.C. 154(b) by 787 days.

(21) Appl. No.: 12/099,134

(22) Filed: Apr. 7, 2008

(65) Prior Publication Data

US 2008/0247769 A1 Oct. 9, 2008

(30) Foreign Application Priority Data

Apr. 9, 2007 (JP) ..... 2007-102060

(51) Int. Cl.
*G03G 15/00* (2006.01)

(52) U.S. Cl. ..... 399/49; 399/51; 399/72

(58) Field of Classification Search ..... 399/46, 399/49, 51, 72
See application file for complete search history.

(56) References Cited

U.S. PATENT DOCUMENTS

| | | | | |
|---|---|---|---|---|
| 5,812,903 | A * | 9/1998 | Yamada et al. | 399/42 |
| 5,839,018 | A * | 11/1998 | Asanuma et al. | 399/43 |
| 6,029,021 | A * | 2/2000 | Nishimura et al. | 399/49 |
| 6,215,968 | B1 * | 4/2001 | Uehara et al. | 399/49 |
| 6,223,007 | B1 * | 4/2001 | Kitagawa et al. | 399/49 |
| 6,288,733 | B1 * | 9/2001 | Nakazawa et al. | 347/133 |
| 6,415,114 | B1 * | 7/2002 | Nakazato et al. | 399/49 |
| 6,501,917 | B1 * | 12/2002 | Karasawa | 399/46 |
| 6,516,162 | B2 * | 2/2003 | Ino et al. | 399/49 |
| 6,529,694 | B1 * | 3/2003 | Fukaya et al. | 399/46 |
| 6,700,595 | B2 * | 3/2004 | Sugiyama et al. | 347/133 |
| 6,701,110 | B2 * | 3/2004 | Ono | 399/226 |
| 6,859,628 | B2 * | 2/2005 | Kobashigawa | 399/44 |
| 7,031,020 | B1 * | 4/2006 | Aoki et al. | 358/1.9 |
| 7,058,326 | B2 * | 6/2006 | Toyama | 399/50 |
| 7,149,439 | B2 * | 12/2006 | Hirata et al. | 399/29 |
| 7,187,879 | B2 * | 3/2007 | Zaima | 399/49 |
| 7,242,876 | B2 * | 7/2007 | Zaima | 399/27 |
| 7,269,362 | B2 * | 9/2007 | Hama et al. | 399/27 |
| 7,336,910 | B2 * | 2/2008 | Kamiya | 399/44 |
| 7,385,737 | B2 * | 6/2008 | Zaima | 358/504 |
| 7,394,999 | B2 * | 7/2008 | Zaima | 399/27 |
| 7,567,761 | B2 * | 7/2009 | Kin et al. | 399/12 |
| 7,577,371 | B2 * | 8/2009 | Zaima | 399/27 |
| 7,639,956 | B2 * | 12/2009 | Naito et al. | 399/26 |
| 7,664,412 | B2 * | 2/2010 | Taguchi et al. | 399/49 |

(Continued)

FOREIGN PATENT DOCUMENTS

JP 62-296669 A 12/1987

(Continued)

*Primary Examiner* — David Gray
*Assistant Examiner* — Geoffrey Evans
(74) *Attorney, Agent, or Firm* — Rossi, Kimms & McDowell LLP

(57) ABSTRACT

An image forming apparatus capable of keeping reproducibility and gradation in balance and outputting high-quality images. A primary electrostatic charger charges a photosensitive drum. A polygon scanner irradiates the drum with a laser beam to form an electrostatic latent image on the drum. A developing device develops the latent image into a toner image by applying a developing bias to the drum. In performing development by the developing device at a preset environmental contrast potential, a CPU determines a required contrast potential for obtaining a target maximum density. The CPU compares between the environmental contrast potential and the required contrast potential. Further, the CPU sets an upper limit value for a set contrast potential to be set to the developing device according to the result of the comparison, and sets an output level of the laser light to be output from the developing device.

3 Claims, 12 Drawing Sheets

U.S. PATENT DOCUMENTS

| | | | | |
|---|---|---|---|---|
| 7,684,715 | B2 * | 3/2010 | Zaima | 399/27 |
| 7,764,889 | B2 * | 7/2010 | Hamaya et al. | 399/44 |
| 2002/0126196 | A1 * | 9/2002 | Yamauchi | 347/129 |
| 2004/0105689 | A1 * | 6/2004 | Shimura et al. | 399/12 |
| 2004/0240899 | A1 * | 12/2004 | Ebe | 399/44 |
| 2005/0030562 | A1 * | 2/2005 | Hama et al. | 358/1.9 |
| 2005/0286086 | A1 * | 12/2005 | Takahashi et al. | 358/3.26 |
| 2006/0098997 | A1 * | 5/2006 | Kim et al. | 399/49 |
| 2006/0140650 | A1 * | 6/2006 | Yokote | 399/27 |
| 2008/0003003 | A1 * | 1/2008 | Watanabe et al. | 399/49 |
| 2008/0025741 | A1 * | 1/2008 | Yamashita et al. | 399/49 |
| 2008/0124115 | A1 * | 5/2008 | Oki | 399/74 |
| 2008/0175608 | A1 * | 7/2008 | Kobashigawa | 399/44 |
| 2008/0205923 | A1 * | 8/2008 | Takeuchi et al. | 399/62 |
| 2010/0067932 | A1 * | 3/2010 | Fujiwara | 399/55 |
| 2010/0266296 | A1 * | 10/2010 | Ochiai | 399/27 |
| 2010/0290799 | A1 * | 11/2010 | Komiya | 399/49 |
| 2011/0064430 | A1 * | 3/2011 | Mitamura et al. | 399/27 |
| 2011/0116118 | A1 * | 5/2011 | Nakase | 358/1.13 |
| 2011/0206394 | A1 * | 8/2011 | Takenaka | 399/46 |
| 2011/0222878 | A1 * | 9/2011 | Ochi et al. | 399/44 |

FOREIGN PATENT DOCUMENTS

| | | | |
|---|---|---|---|
| JP | 63-185279 | A | 7/1988 |

* cited by examiner

IMAGE FORMING APPARATUS

BACKGROUND OF THE INVENTION

1. Field of the Invention

The present invention relates to an image forming apparatus, such as a printer and a copying machine.

2. Description of the Related Art

There have been known the following techniques for calibrating an output image to be output from an image forming apparatus, such as a copying machine or a printer.

A specific test pattern is formed on a recording sheet by the image forming apparatus, and then image information, such as density or chromaticity, of the test pattern formed on the recording sheet is read by an image reading means. Thereafter, density correction, gradation correction, and the like correction are performed based on the image information, whereby image quality is adjusted to desired characteristics, and its stability is enhanced (see e.g. Japanese Patent Laid-Open Publication No. S62-296669, and Japanese Patent Laid-Open Publication No. S63-185279). This method is called calibration.

In the case of an electrophotographic image forming apparatus, for example, an image calibration method is known in which a charge bias voltage and a developing bias voltage are controlled to thereby change a latent image contrast potential and a developing contrast potential so as to perform correction such that image density is maximized (image density-maximizing correction). Further, an image calibration method is also known in which a gradation correction table is changed so as to correct gradation characteristics.

However, in the conventional image density-maximizing correction, the developing contrast potential is controlled so as to obtain the maximum density, but it often occurs that the resulting developing contrast potential does not match with a developing contrast potential for achieving high image quality.

In the electrophotographic image forming apparatus, through the use of high contrast, it is possible to stabilize an electrostatic process and enhance image reproducibility, and hence it is sometimes desired to determine a contrast potential irrespective of the maximum density. In this case, adjustment of the maximum density is performed using a γ correction table (γ correction circuit), which can cause reduction of the number of gradations depending on the amount of adjustment.

SUMMARY OF THE INVENTION

The present invention provides an image forming apparatus which is capable of keeping reproducibility and gradation in balance and outputting high-quality images.

The present invention provides an image forming apparatus comprising a photosensitive member, a charging unit configured to electrostatically charge the photosensitive member, an exposure unit configured to irradiate the electrostatically charged photosensitive member with laser light to form an electrostatic latent image on the photosensitive member, a development unit configured to develop the electrostatic latent image on the photosensitive member into a toner image by applying a developing bias to the photosensitive member, a determination unit configured to determine a second contrast potential for obtaining a desired density, when development is performed by the development unit at a first contrast potential which is preset, a comparison unit configured to make a comparison between the first contrast potential and the second contrast potential, and a control unit configured to set an upper limit value for a set contrast potential to be set to the development unit according to a result of the comparison made by the comparison unit, and set an output level of the laser light to be output from the exposure unit, which is required for obtaining a desired density when development is performed at a third contrast potential to which the set contrast potential is changed from the first contrast potential.

In the image forming apparatus according to the present invention, the charging unit electrostatically charges the photosensitive member, and the exposure unit irradiates the electrostatically charged photosensitive member with laser light to form an electrostatic latent image on the photosensitive member. The development unit develops the electrostatic latent image on the photosensitive member into a toner image by applying a developing bias to the photosensitive member. Further, the determination unit determines a second contrast potential for obtaining a desired density, when development is performed by the development unit at a first contrast potential which is preset, and the comparison unit makes a comparison between the first contrast potential and the second contrast potential. The control unit sets an upper limit value for a set contrast potential to be set to the development unit according to a result of the comparison made by the comparison unit, and sets an output level of the laser light to be output from the exposure unit, which is required for obtaining a desired density when development is performed at a third contrast potential to which the set contrast potential is changed from the first contrast potential.

With this arrangement, it is possible to keep reproducibility and gradation in balance and output high-quality images.

The features and advantages of the invention will become more apparent from the following detailed description taken in conjunction with the accompanying drawings.

DETAILED DESCRIPTION OF THE EMBODIMENTS

The present invention will now be described in detail with reference to the drawings showing preferred embodiments thereof.

Figure 1:
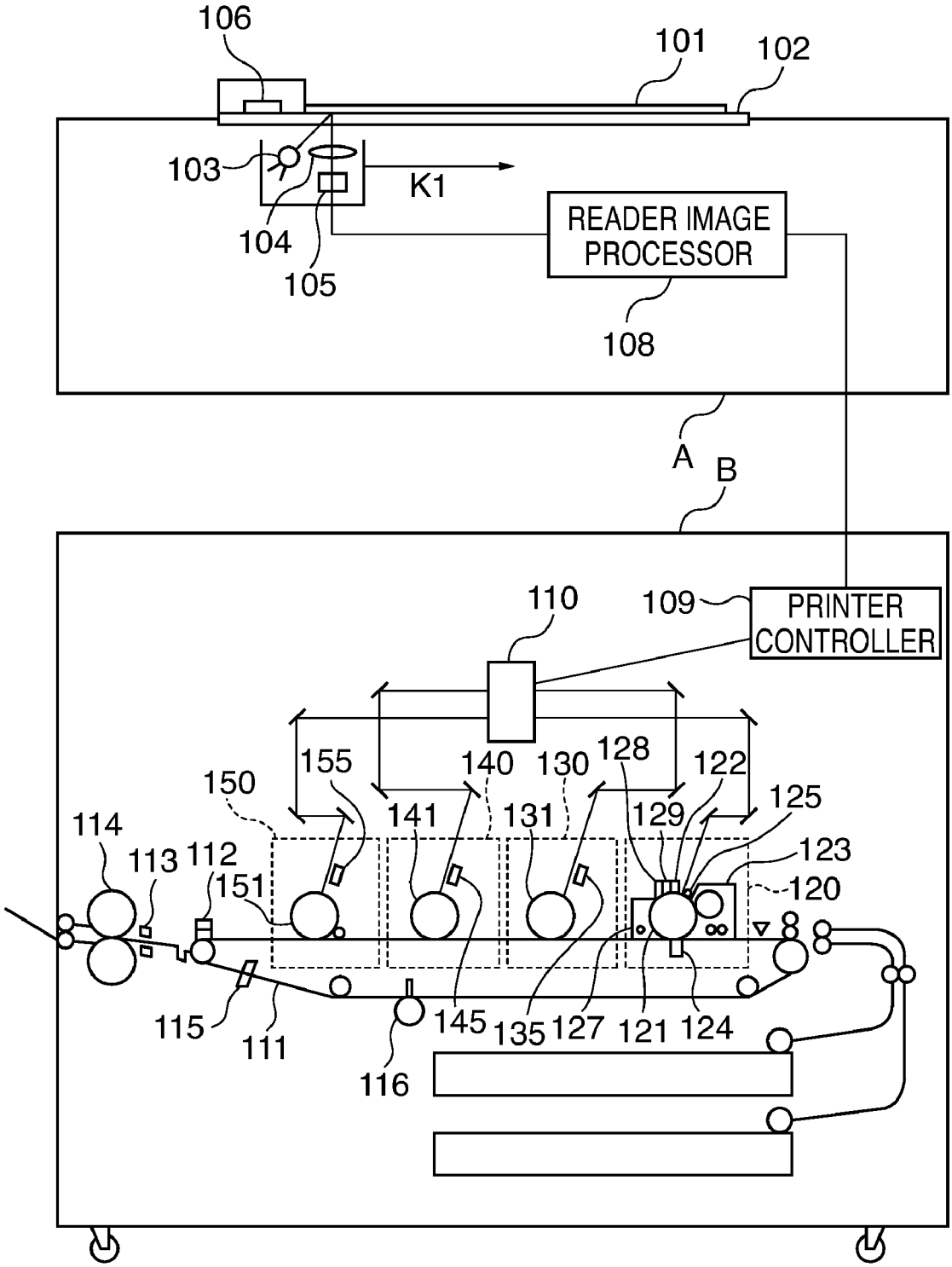
FIG. 1 is a view of an image forming apparatus according to an embodiment of the present invention.

FIG. 1 is a view of an image forming apparatus according to an embodiment of the present invention.

The image forming apparatus shown in FIG. 1 is an electrophotographic color copying machine having a plurality of photosensitive drums. However, the present invention is not limited to the electrophotographic color copying machine, but it is to be understood that the present invention can also be applied to other various types of electrophotographic copying machines or printers and non-electrophotographic image forming apparatuses.

Hereafter, a description will be given of the arrangement of the image forming apparatus together with its operation.

The image forming apparatus is comprised of a reader unit A for reading images of originals and a printer unit B for performing an image forming operation. In the reader unit A, an original 101 placed on an original platen glass 102 is irradiated with light from a light source 103, and reflected light from the original passes through an optical system 104 to form an image on a CCD sensor 105. The CCD sensor 105 generates red (R), green (G), and blue (B) color component signals by respective three R, G, and B CCD line sensors arranged in three rows to form a CCD line sensor group.

These reading optical system units perform scanning in a direction indicated by an arrow in FIG. 1 to thereby convert the original 101 into line-by-line electric signal data rows. Disposed on the original platen glass 102 is a reference white plate 106 for use in determining the white level of the CCD sensor 105 and performing shading processing in a thrust direction of the CCD sensor 105.

The image signals obtained by the CCD sensor 105 are subjected to image processing by a reader image processor 108, and then are delivered to the printer unit B, followed by being subjected to image processing by a printer controller 109.

Figure 2:
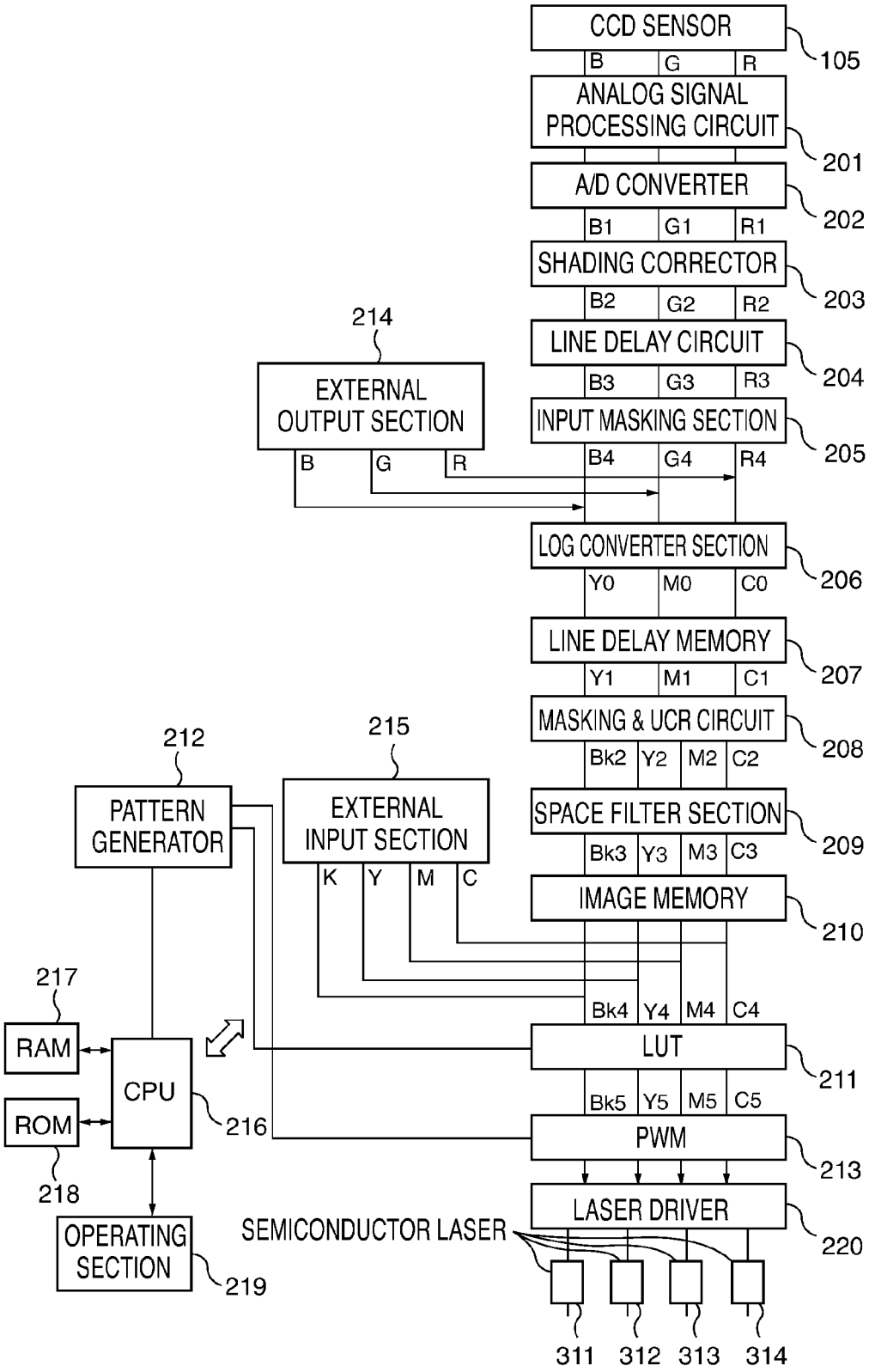
FIG. 2 is a block diagram useful in explaining flows of image signals in a reader image processor and a printer controller appearing in FIG. 1.

FIG. 2 is a block diagram useful in explaining flows of image signals in the reader image processor and the printer controller in FIG. 1.

As shown in FIG. 2, the image signals output from the CCD sensor 105 are input to an analog signal processing circuit 201 where the signals are subjected to gain adjustment and offset adjustment. Thereafter, the adjusted image signals are converted by an A/D converter 202 into respective 8-bit color-specific digital image signals R1, G1, and B1.

Then, the digital image signals R1, G1, and B1 are input to a shading corrector 203 where they are subjected to known shading correction on a color-by-color basis, using reading signals obtained by reading the reference white plate 106.

Since the CCD line sensors forming the CCD sensor 105 are arranged in parallel at predetermined space intervals, a line delay circuit 204 corrects spatial shifts in the sub scanning direction. An input masking section 205 converts a reading color space determined by spectral characteristics of R, C, and B filters of the CCD sensor 105 into an NTCS standard color space, and performs a 3×3 matrix operation.

A light amount/density converter section (LOG converter section) 206 is formed by a look-up table (LUT) RAM. The light amount/density converter section 206 converts luminance signals R4, G4, and B4 into density signals C0, M0 and Y0, respectively, and inputs the density signals C0, M0 and Y0 to a line delay memory 207. The line delay memory 207 performs predetermined delay processing on two of the density signals C0, M0, and Y0 so as to synchronize signal timings according to the positions of the respective line sensors.

A masking & UCR circuit 208 extracts a black signal (Bk) from three primary color signals Y1, M1, and C1 input therein. Further, the masking & UCR circuit 208 performs computation for correcting the turbidity of the color of a recording color material in the printer unit B. Then, the masking & UCR circuit 208 sequentially outputs signals Y2, M2, C2, and Bk2 with a predetermined bit width (8-bit width) for each reading operation.

A space filter section (output filter) 209 performs edge emphasis processing or smoothing processing. An image memory 210 temporarily stores signals Y3, M3, C3, and Bk3 obtained through the above processing, and then outputs the signals to a LUT 211 in timing synchronous with image formation by the printer unit B. The LUT 211 performs density correction so as to match the image signals to ideal gradation characteristics of the printer unit 3, in the reader unit A.

The signals output from the LUT 211 are sequentially delivered to the printer controller 109. It should be noted that the image forming apparatus is provided with a pattern generator 212 which registers therein patterns, referred to hereinafter with reference to FIGS. 10 and 11, and signals indicative of the patterns can be directly delivered to a pulse width modulator 213. Signals Y5, M5, C5, and Bk5 obtained through the above processing are delivered to the printer controller 109.

Further, in FIG. 2, there are shown an external output section 214, an external input section 215, a CPU 216, a RAM 217, a ROM 218, an operating section 219, a laser driver 220, and semiconductor lasers 311 to 314.

Next, referring again to FIG. 1, a description will be given of the printer unit B.

The image signals delivered to the printer controller 109 are converted into pulse-width modulated laser beams by the laser driver 220. The laser beams scanned by a polygon scanner 110 are irradiated onto photosensitive drums 121, 131, 141, and 151 of respective image forming sections 120, 130, 140, and 150.

The yellow (Y) image forming section 120, the magenta (M) image forming section 130, the cyan (C) image forming section 140, and the black (Bk) image forming section 150 form images of the respective associated colors.

The image forming sections 120, 130, 140, and 150 are substantially identical in construction and operation. Therefore, in the following, the Y image forming section 120 will be described in detail, and description of the other image forming sections is omitted. In the Y image forming section 120, an electrostatic latent image is formed on the surface of the photosensitive drum 121 by a laser beam from the polygon scanner 110.

A primary electrostatic charger 122 charges the surface of the photosensitive drum 121 to a predetermined potential for preparation for forming the electrostatic latent image. A developing device 123 develops the electrostatic latent image on the photosensitive drum 121 by a developer to thereby form a toner image. A transfer blade 124 performs electric discharge from the reverse surface of a transfer belt 111 to thereby transfer the toner image on the photosensitive drum 121 onto a recording sheet on the transfer belt 111.

After the toner image is transferred onto the transfer belt 111, the photosensitive drum 121 has the surface thereof cleaned by a cleaner 127 and destaticized by an auxiliary charger 128, and further, residual charge remaining on the photosensitive drum 121 is removed by a pre-exposure lamp 129, so that excellent charge can be obtained from the primary electrostatic charger 122.

The recording sheet having the toner image transferred thereon is conveyed by the transfer belt 111, and then toner images of the respective colors formed on the M, C, and Bk image forming sections, respectively, are sequentially transferred on the recording sheet, whereby a four-color image is formed on the surface of the recording sheet.

The recording sheet having passed the Bk image forming section 150 is destaticized by a destaticizing charger 112 for easy separation from the transfer belt 111, followed by being separated from the same. After the recording sheet is separated from the transfer belt 111, the transfer belt 111 is destaticized by a transfer belt destaticizing charger 115, and is then cleaned by a belt cleaner 116, whereby the transfer belt 111 gets prepared for attracting a recording sheet again.

The separated recording sheet is charged by a pre-fixation charger 113 so as to supplement toner adhesiveness to thereby prevent occurrence of image disturbance, and then the toner image is fixed by a fixing device 114.

In FIG. 1, reference numerals 125, 135, 145, and 155 denote respective surface potentiometers.

In the following, a description will be given of image forming condition control characterizing the present invention.

The characterizing features of the present invention assume that the image forming apparatus is configured such that a contrast potential (referred to hereinafter) for use in an image forming operation is optimized for image reproducibility, and maximum density control is performed by the γ correction circuit (LUT 211) together with gradation correction. Under the assumption, the present invention provides a solution to the problem that when a laser output signal level for obtaining maximum density is lowered (in a case where maximum density can be obtained with a lower value of the signal level), the resulting decrease in the number of gradations causes degradation of gradation characteristics.

To solve this problem, a comparison is made between a to-be-set contrast potential (first contrast potential) and a contrast potential (second contrast potential) required for obtaining maximum density, and then a set contrast potential (third contrast potential) for use in an actual image forming operation is determined based on the result of the comparison. The to-be-set contrast potential is configured such that image reproducibility is optimized according to each ambient environment, and is normally higher than the contrast potential required for obtaining maximum density.

Figure 3:
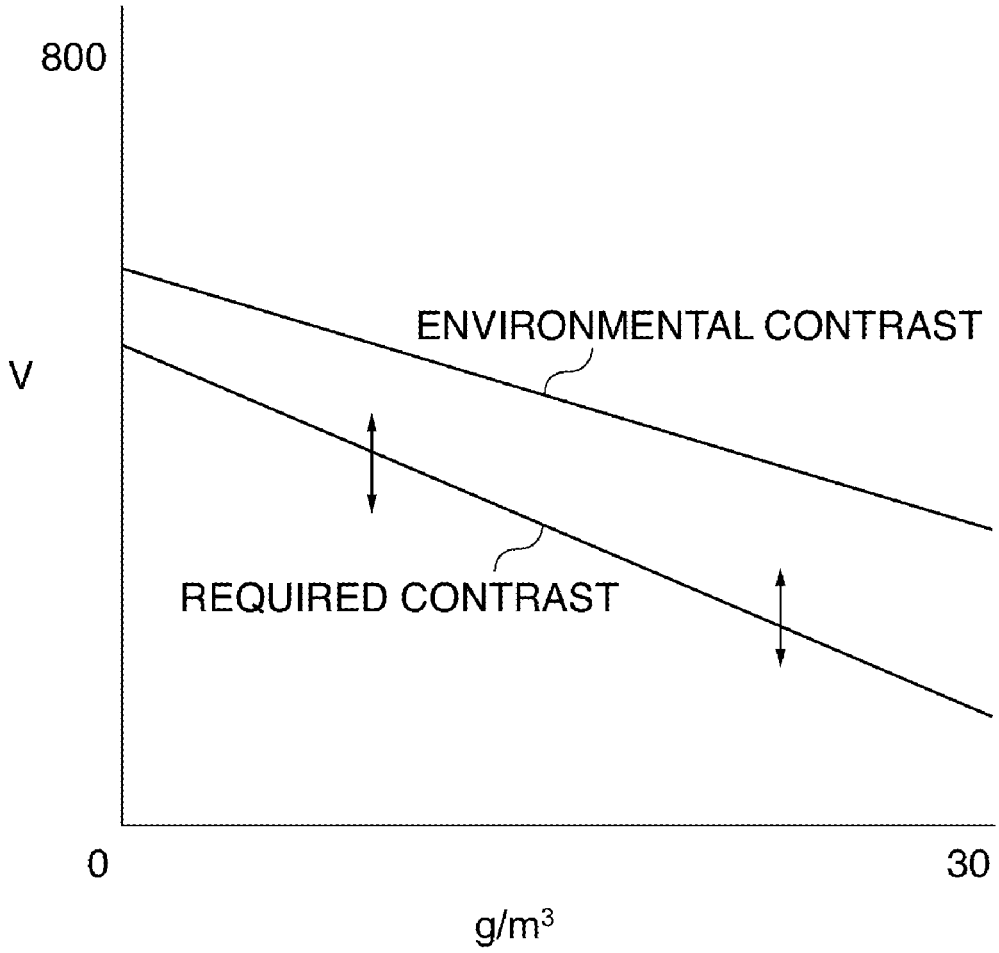
FIG. 3 is a diagram showing an environmental contrast potential and a required contrast potential in the image forming apparatus.

In the present embodiment, the to-be-set contrast potential is referred to as the environmental contrast potential (first contrast potential), and the contrast potential required for obtaining maximum density is referred to as the required contrast potential (second contrast potential). FIG. 3 shows in detail the relationship between these two contrast potentials.

FIG. 3 is a diagram showing the environmental contrast potential and the required contrast potential in the image forming apparatus in FIG. 1.

In FIG. 3, the abscissa represents an absolute moisture content indicative of an ambient environment. The result of measurement of the required contrast potential varies with the state of the apparatus, and hence the difference between the environmental contrast potential and the required contrast potential also varies.

The difference between the environmental contrast potential and the required contrast potential is corrected by the LUT 211, so that as the difference is larger, the laser output signal level becomes lower. For this reason, the difference between the environmental contrast potential and the required contrast potential is detected, and the set contrast potential is controlled (limited (by a lower limit)) based on the detected difference, to thereby prevent the laser output signal level from lowering and gradation characteristics from being degraded. Hereafter, a description will be given of control for achieving this goal.

In the present embodiment, the image forming apparatus is provided with a first calibration function for controlling the contrast potentials and a second calibration function for controlling the γ correction circuit (LUT 211) for γ correction of image data.

First, a description will be given of a first calibration process.

Figure 4:
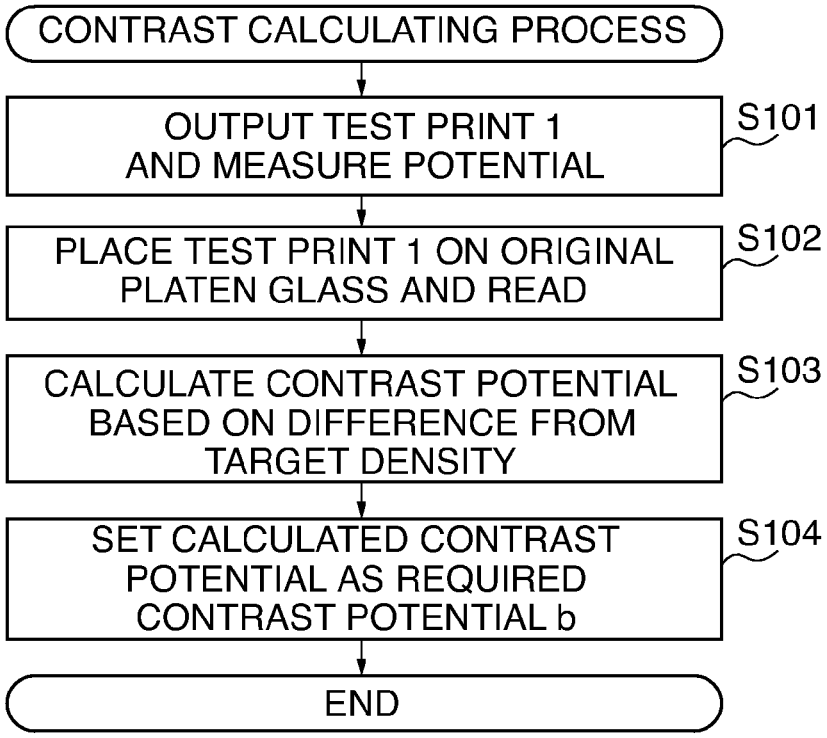
FIG. 4 is a flowchart of a required contrast-calculating process in a first calibration process executed by the image forming apparatus.

FIG. 4 is a flowchart of a required contrast-calculating process in the first calibration process executed by the image forming apparatus.

The present process is executed by the CPU 216 appearing in FIG. 2.

Referring to FIG. 4, first, in a step S101, a test print 1 is output by the above described image forming processing. Before execution of the image forming processing, it is determined whether or not a recording sheet required for forming the test print 1 is present, and if the recording sheet is not present, a warning is displayed.

Further, as a contrast potential (referred to hereinafter) for forming an image of the test print 1, a value predicted to attain a target density in a standard condition in each environment is registered as an initial value in advance, and this registered value is used.

Figure 5:
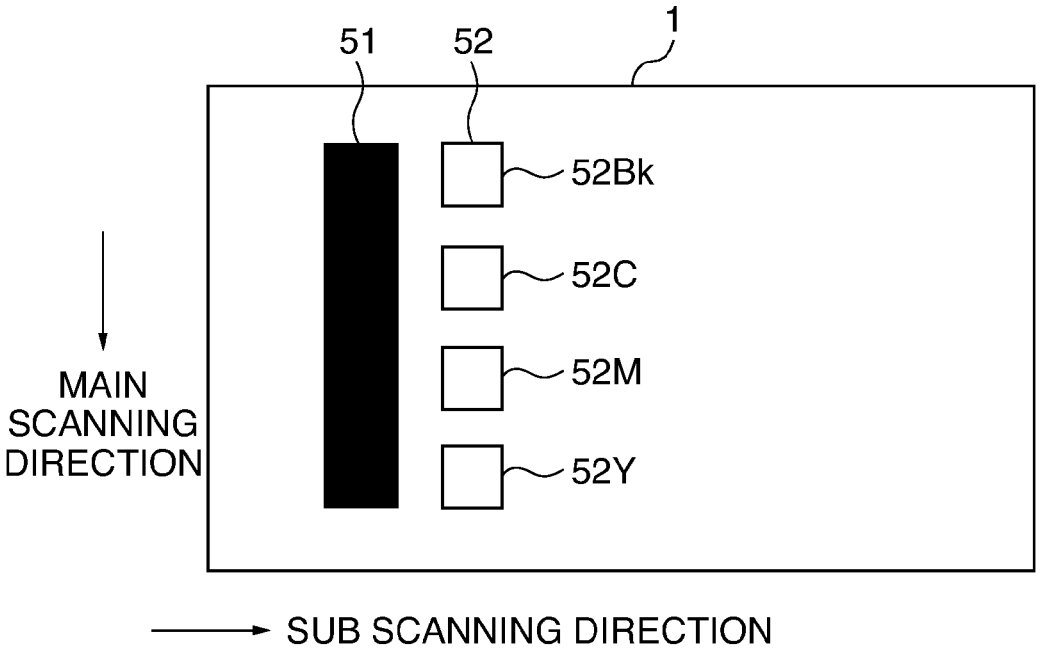
FIG. 5 is a view of a test pattern.

As shown in FIG. 5, the test print 1 includes a band pattern 51 of intermediate gradation densities of four colors Y, M, C, and Bk, and a patch pattern 52 of Y, M, C, and Bk maximum density patches (corresponding to a density signal level of 255). An actual contrast potential used for forming each of the density patches is measured by an associated one of the surface potentiometers 125, 135, 145, and 155.

In a step S102, the output test print 1 is read through the original platen glass 102, and obtained RGB values are converted into optical densities using the LUT 211 for the conversion. In the LUT 211, coefficients obtained using equations (1) are set in advance. A correction coefficient (k) is adjusted such that optical density can be obtained.

[equations 1]

$$C=-kc\times\log 10(R/255)$$

$$M=-km\times\log 10(G/255)$$

$$Y=-ky\times\log 10(B/255)$$

$$Bk=-kbk\times\log 10(G/255) \quad (1)$$

Figure 6:
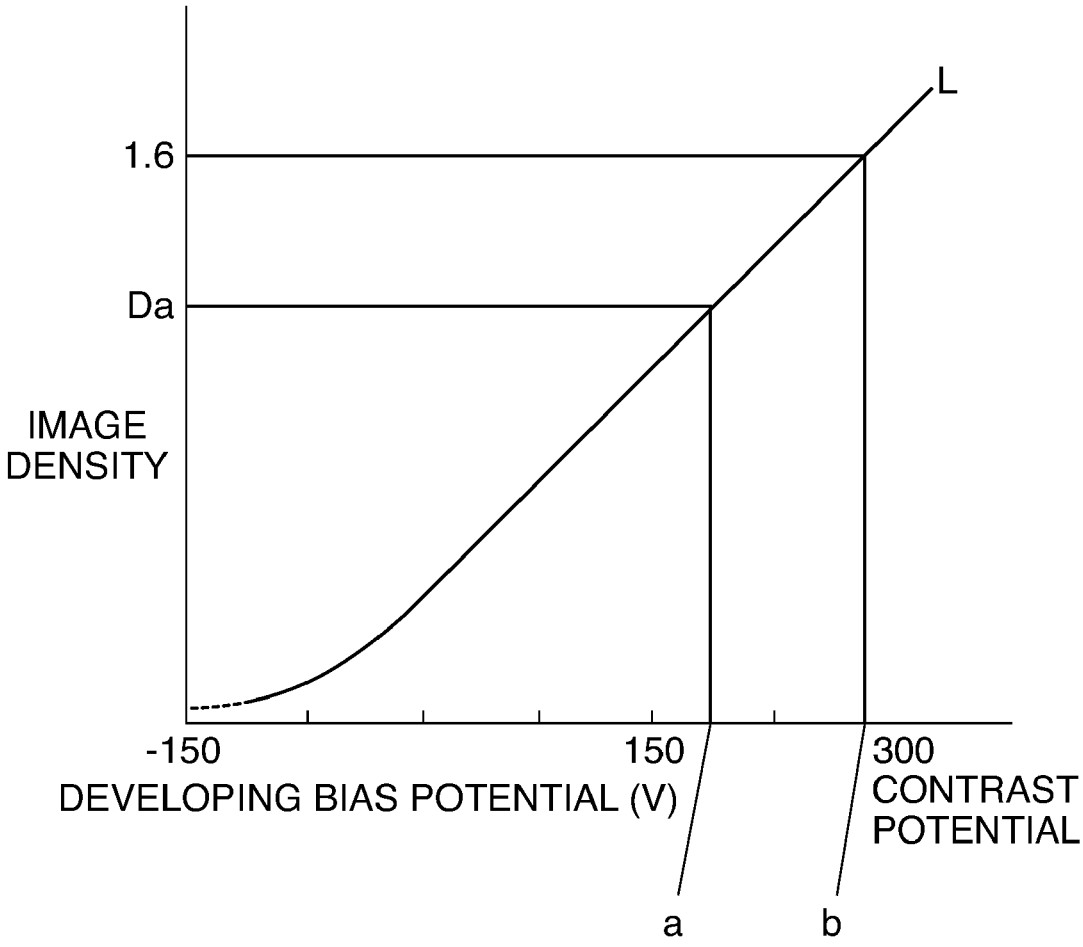
FIG. 6 is a diagram showing the relationship between contrast potential and image density in the image forming apparatus.

FIG. 6 is a diagram showing the relationship between the contrast potential and the image density in the image forming apparatus.

When a maximum density obtained at a contrast potential "a" used at a certain time point is Da, in a density range (densities of 0.8 to 2.0) close to the maximum density, the image density almost always linearly corresponds to the contrast potential as indicated by a solid line L.

Here, the contrast potential "a" is defined as the difference between a surface potential of each of the photosensitive drums 121, 131, 141, and 151 exhibited when primarily charged from the developing bias potential, and a surface potential of the same irradiated with a laser beam at a maximum level by an associated one of the semiconductor lasers 311, 312, 313, and 314 emitted.

In the present embodiment, a target maximum density is set to 1.6, and therefore the contrast potential is calculated such that the maximum density becomes equal to 1.6 (step S103). It should be noted that a contrast potential "b" in FIG. 6 is obtained using the following equation (2):

$$b=(a+ka)\times 1.6/Da \quad (2)$$

wherein ka represents a correction coefficient. The value of the correction coefficient is preferably optimized according to the type of the developing method. The calculated contrast potential is set as the required contrast potential "b" (step S104), followed by terminating the present process.

Figure 7:
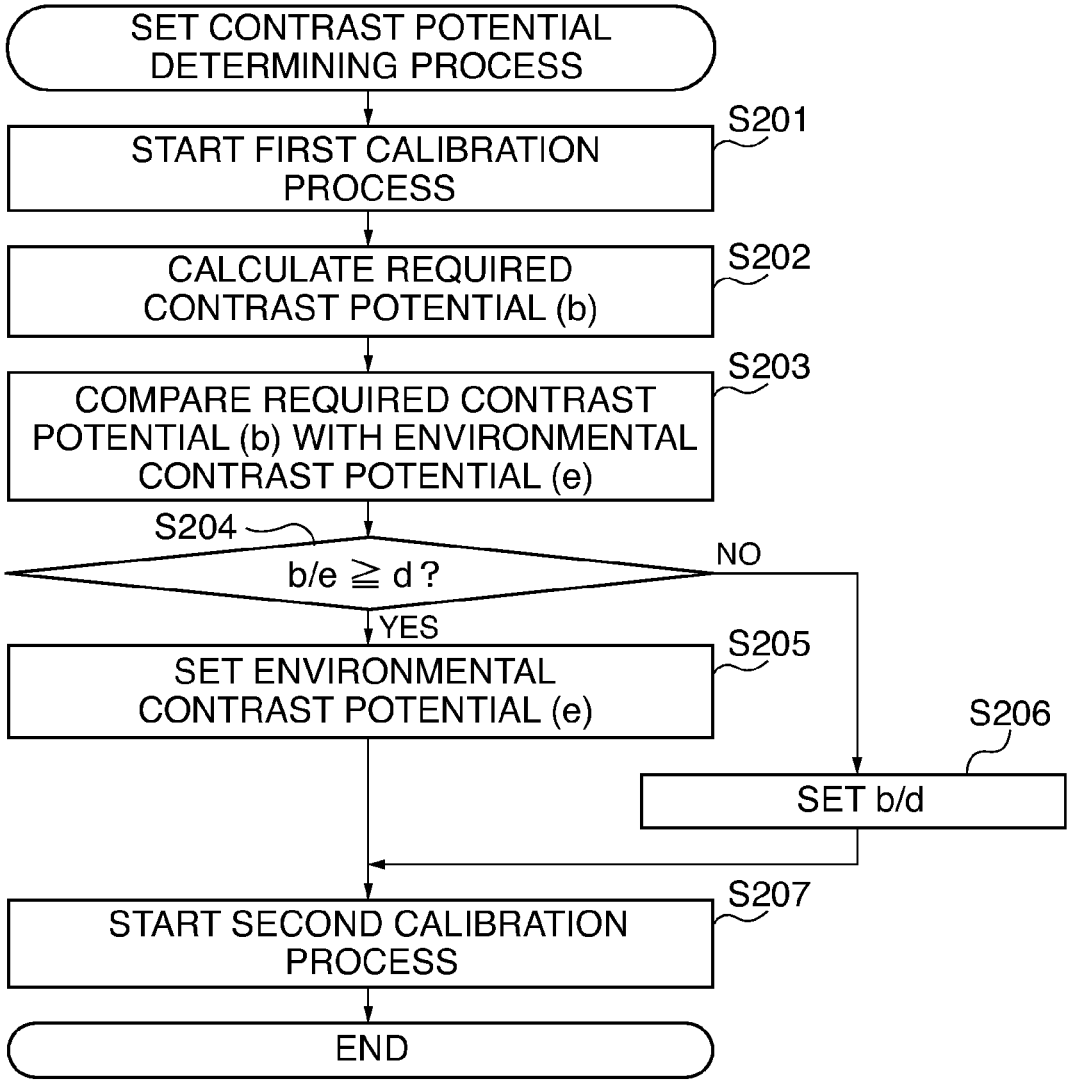
FIG. 7 is a flowchart of a set-contrast potential-determining process executed by the image forming apparatus.

FIG. 7 is a flowchart of a set contrast potential-determining process executed by the image forming apparatus.

The present process is executed by the CPU 216 appearing in FIG. 2.

As described above, according to the present invention, a comparison is made between the to-be-set contrast potential (environmental contrast potential) and the required contrast potential for attaining a target maximum density, and the set contrast potential is determined based on the result of the comparison.

Referring to FIG. 7, when the first calibration process is started (step S201), the required contrast potential "b" for attaining the target maximum density of 1.6 by the above-described method is calculated (step S202). Then, an environmental contrast potential "e" is read out by looking up a pre-stored environment setting contrast table according to a value of output from an environment sensor that measures the ambient environment.

Further, the required contrast potential "b" and the environmental contrast potential "e" are compared with each other (step S203), and if $b/e \geqq d$ holds (YES to a step S204), the environmental contrast potential "e" is set as a set contrast potential "c" (step S205). More specifically, if it is determined, based on the result of the comparison, that the ratio of the required contrast potential "b" (second contrast potential) to the environmental contrast potential "e" (first contrast potential) is not smaller than a predetermined value "d", the set contrast potential "c" (third contrast potential) is held at the first contrast potential "e". If $b/e<d$ holds (No to the step S204), the set contrast potential "c" is set such that $c=b\times 2$ holds (step S206). Then, a second calibration process, described hereinafter, is started (step S207), followed by terminating the present process. More specifically, if it is determined, based on the result of the comparison, that the ratio of the required contrast potential "b" (second contrast potential) to the environmental contrast potential "e" (first contrast potential) is smaller than the predetermined value "d", the third contrast potential "c" is set to an upper limit value ($b\times 2$) which is smaller than the first contrast potential "e".

In the present embodiment, the predetermined value "d" is set to 0.5. More specifically, in the present embodiment, the adjustment amount of the maximum density is limited by limiting the set contrast potential such that it becomes smaller than a value which is twice as large as the required contrast potential. Thus, the contrast is increased to the limit while at least maintaining gradation characteristics, with the limited maximum density adjustment amount by the LUT 211, to thereby secure reproducibility.

Of course, since the optimal value of the set contrast potential differs depending on the characteristics of an image forming apparatus, it is not limitative to set the set contrast potential "c" using the ratio of $b/e=0.5$ as a threshold, but the conditional equations and the configuration values may be determined according to the apparatus.

Next, a brief description will be given of a method of obtaining a grid potential and a developing bias potential from the set contrast potential.

Figure 8:
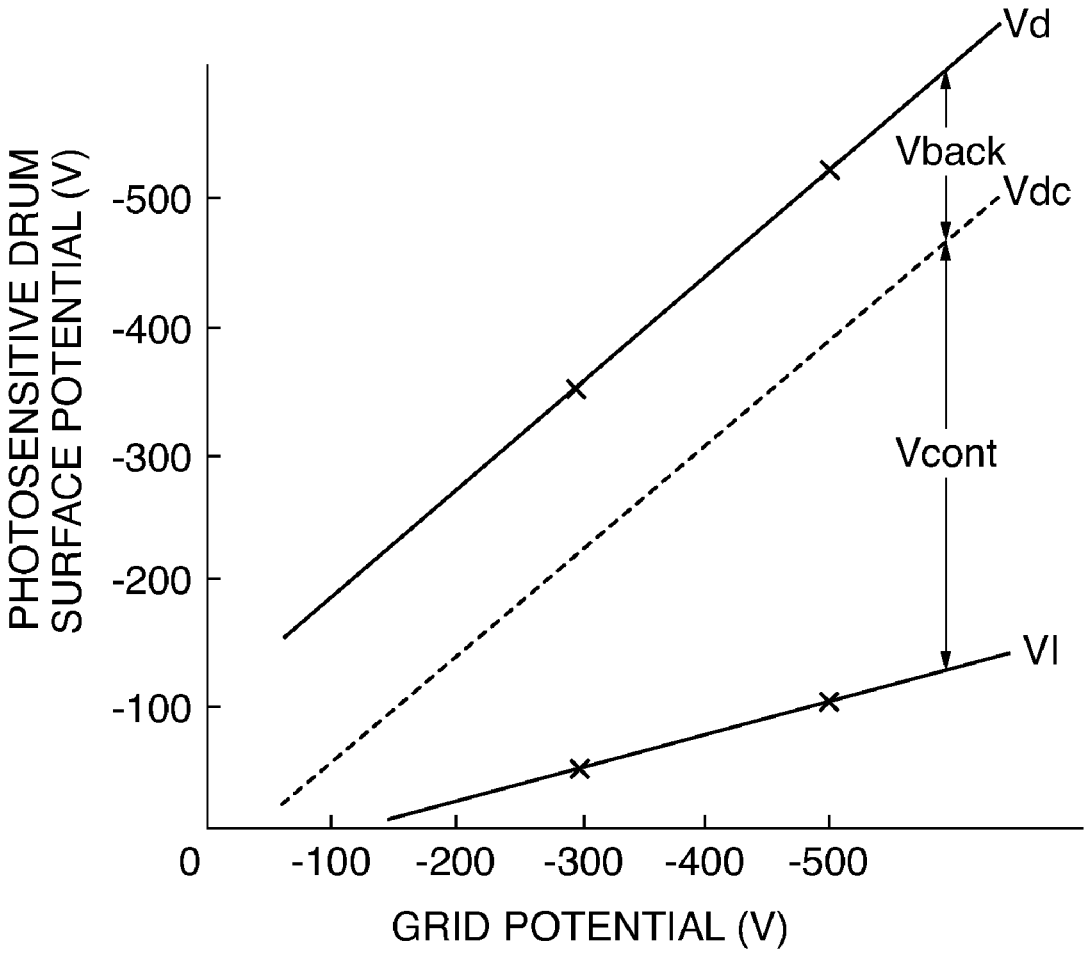
FIG. 8 is a diagram showing the relationship between the grid potential and the surface potential of a photosensitive drum in the image forming apparatus.

FIG. 8 is a diagram showing the relationship between the grid potential and the surface potential of a photosensitive drum in the image forming apparatus.

Referring to FIG. 8, after setting the grid potential to −300 V, a surface potential Vd of each of the photosensitive drums scanned by an associated one of the semiconductor lasers 311, 312, 313, and 314 emitted at a minimum emission pulse level is measured by the associated one of the surface potentiometers 125, 135, 145, and 155.

Further, a surface potential Vl of each of the photosensitive drums scanned by an associated one of the semiconductor lasers 311, 312, 313, and 314 emitted at a maximum emission pulse level is measured by the associated one of the surface potentiometers 125, 135, 145, and 155. In the same manner, the surface potentials Vd and Vl scanned when the grid potential is set to −500 V are measured.

The relationship between the grid potential and the surface potential of each of the photosensitive drums can be determined by interpolation or extrapolation of the data obtained at a grid potential of −300V and the data obtained at a grid potential of −500V. The control for obtaining the potential data is referred to as the potential measurement control.

The developing bias Vdc is set by setting a potential difference Vback (set to 150 V in the present example) from the surface potential Vd such that fog toner is prevented from adhering to an image. The contrast potential Vcont is the differential voltage between the developing bias Vdc and the surface potential Vl, and a larger maximum density can be obtained as the contrast potential Vcont is larger.

A grid potential and a developing bias potential required to set the determined contrast potential "c" can be determined by calculation based on the relationship shown in FIG. 8.

Figure 9:
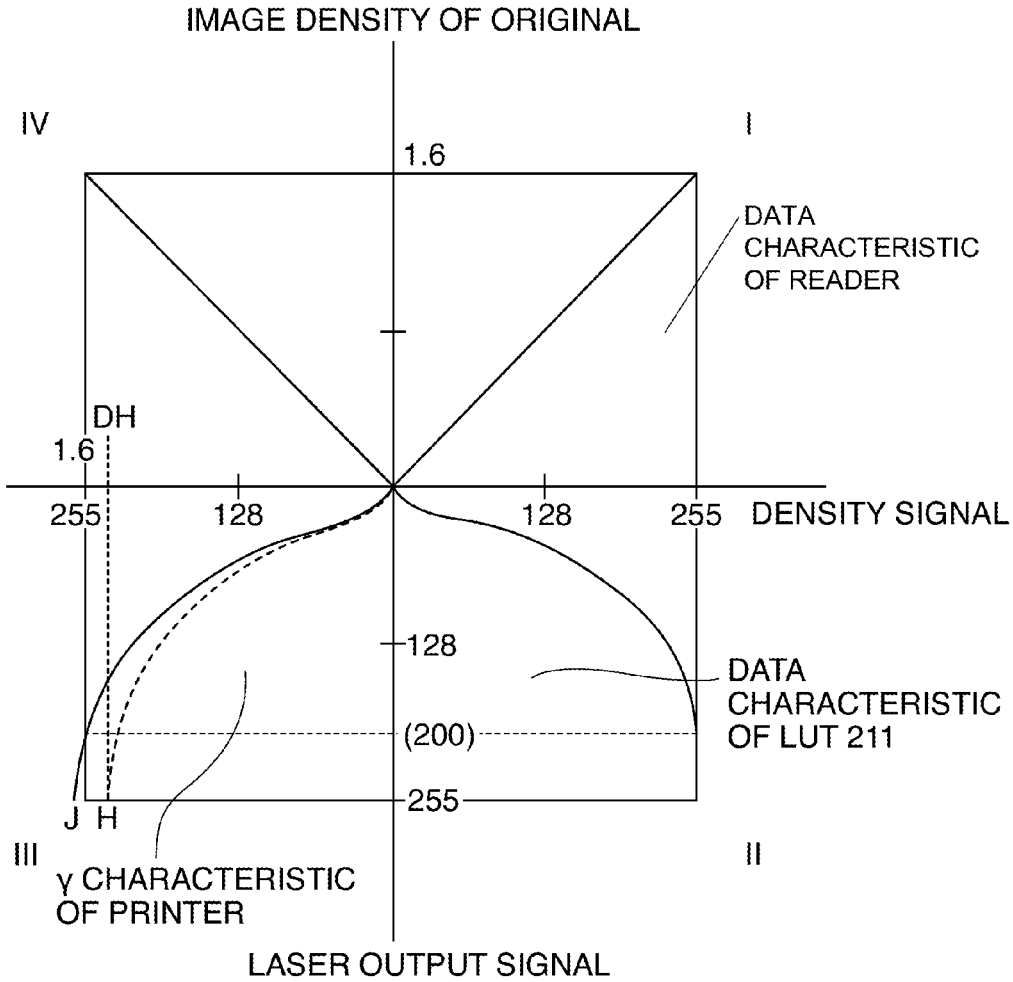
FIG. 9 is a characteristic conversion diagram showing density reproduction characteristics of the image forming apparatus exhibited in reproducing the density of an image of an original.

FIG. 9 is a characteristic conversion diagram showing density reproduction characteristics of the image forming apparatus exhibited in reproducing the density of an image of an original.

Referring to FIG. 9, Quadrant I shows a characteristic of the reader unit A for converting the image density of an original into a density signal. Quadrant II shows a characteristic of the LUT 211 for converting the density signal into a laser output signal. Quadrant III shows a characteristic of the printer unit B for converting the laser output signal into an output density. A characteristic of the printer unit B as a result of the above-described control for setting the set contrast potential to be higher than the contrast potential for obtaining the target density is indicated by a solid line J in Quadrant III.

As is apparent from FIG. 9, by assigning 255 density signals to 255 or a smaller number of laser output signals according to the LUT 211, the maximum density is adjusted.

However, the number of laser gradations is necessarily not larger than 255, and hence when the amount of maximum density adjustment according to the LUT 211 is large, there is a possibility that an image defect, such as a false contour, will occur due to the reduced number of gradations. For this reason, the settings of the contrast are limited as described hereinbefore.

In a case where the printer unit B has a characteristic that a target density of 1.6 is not reached as indicated by a broken line H, it is impossible to reproduce densities between a density DH and the target density of 1.6, since the LUT 211 is not capable of increasing the maximum density itself however it may be configured.

Quadrant IV shows the relationship between the density of an original and the recording density, and the characteristic of the relationship represents overall gradation characteristics of the image forming apparatus according to the present embodiment.

Next, a description will be given of the second calibration process.

Figure 10:
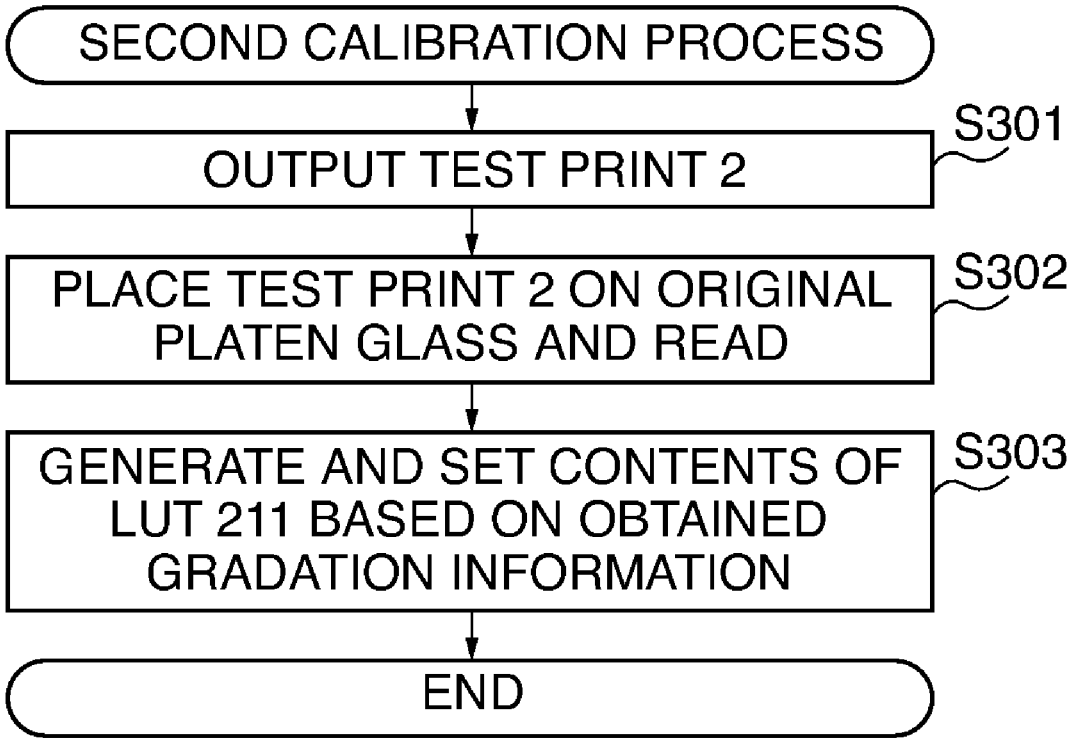
FIG. 10 is a flowchart of a second calibration process executed by the image forming apparatus.

FIG. 10 is a flowchart of the second calibration process executed by the image forming apparatus.

The present process is executed by the CPU 216 appearing in FIG. 2.

A description will be given of a method of gradation correction including the aforementioned maximum density adjustment and the function of the LUT 211.

As shown in FIG. 9, in the present image forming apparatus, in order to make linear the gradation characteristic in Quadrant IV, a curved portion of the recording characteristic of the printer unit B in Quadrant III is corrected by the characteristic of the LUT 211 in Quadrant IX. The contents of the LUT 211 can be easily generated by inverting input-output relationship of characteristics in Quadrant III. It should be noted that in the present embodiment, image processing is performed using 8-bit digital signals, and therefore the number of gradation levels is 256.

First, a test print 2 is output (step S301). It should be noted that in the output of the test print 2, image formation is performed without operating the LUT 211.

Figure 11:
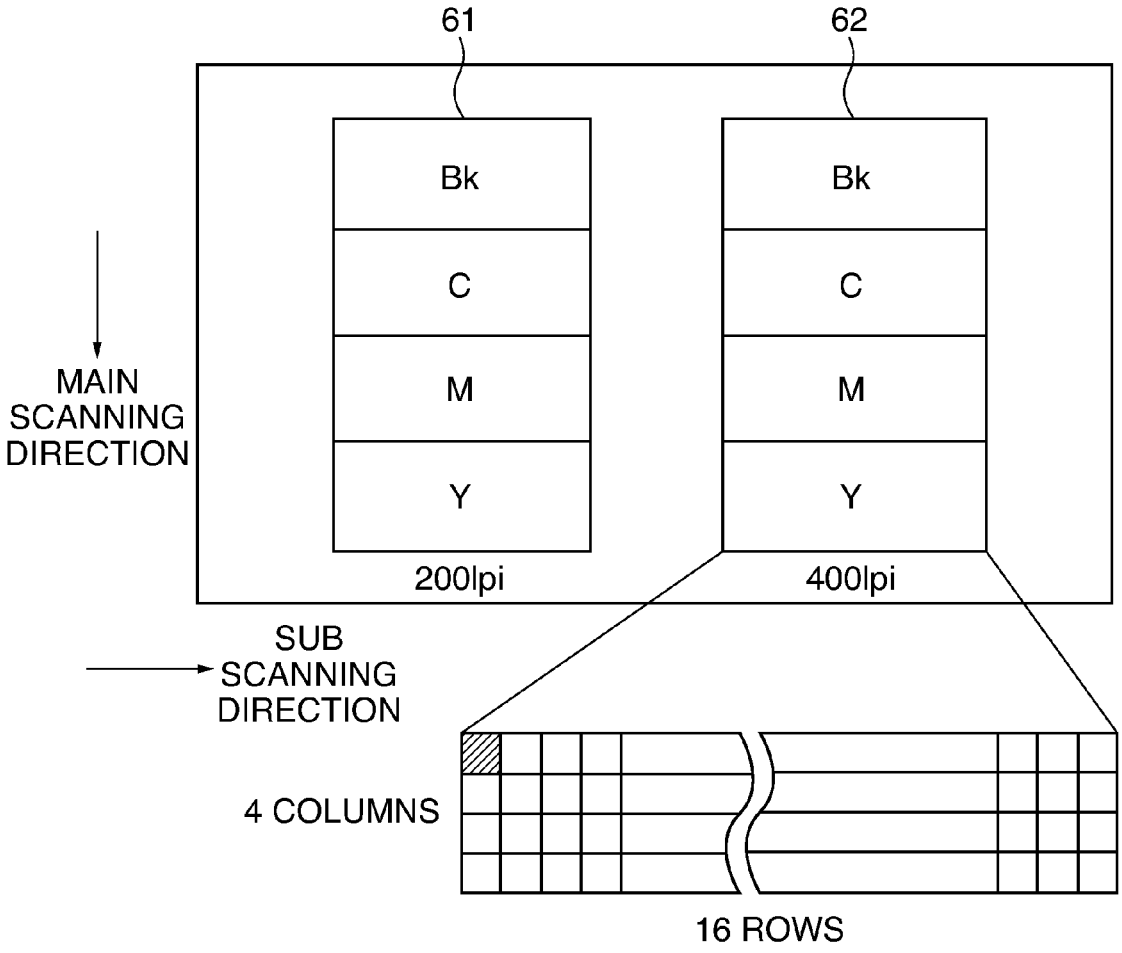
FIG. 11 is a view of gradation patch groups.

As shown in FIG. 11, the test print 2 is comprised of gradation patch groups formed by patches for the colors Y, M, C, and Bk, each color patch set being comprised of 4 (columns)×16 (rows) (as viewed from the sub scanning direction) gradations, i.e. a total of 64 gradations. As for the 64 gradations, laser output levels are mainly assigned to gradations belonging to a low-density range of the 256 gradations. By doing this, it is possible to favorably adjust gradation characteristics in highlighted portions.

In FIG. 11, the gradation patch group 61 has a resolution of 200 lpi (lines/inch), and the gradation patch group 62 has a resolution of 400 lpi. Formation of images of the respective resolutions can be achieved by providing each of the pulse width modulators 213 associated with the respective colors, with a plurality of cycles of triangular wave for use in comparison with image data to be processed.

It should be noted that the present image forming apparatus forms gradation images at a resolution of 200 lpi, and line images, such as characters, at a resolution of 400 lpi. In the present embodiment, gradation patterns are output at the two resolutions for the same gradation levels. However, when a difference in resolution causes a significant difference in gradation characteristics, it is more preferable to configure the gradation levels according to the resolution.

Each of density values read by the reader unit A and corrected is associated with a laser output level with reference to a location of a corresponding patch of the gradation pattern, and the relationship between the laser output level and the density is stored in a memory (step S302).

At this stage, it is possible to obtain the characteristic of the printer unit B shown in Quadrant III in FIG. 9, and determine the LUT 211 of the printer unit B by inverting the input-out relationship of the characteristic of the printer unit B. Thus, the LUT 211 is configured (step S303), followed by terminating the present process.

In determining the contents of the LUT 211 by computation, since there are only a number of data items corresponding to the number of gradations of the patch pattern, missing data items are generated by interpolation so as to enable the laser output level to be associated with any corresponding one of all the levels 0 to 255 of the density signal, The above-described control process makes it possible to obtain a linear gradation characteristic toward the target density.

In the present embodiment, the first calibration process and the second calibration process are sequentially performed. Actual operations of the user and operations of the calibration processes will be described hereinbelow. The user can perform the calibration as desired.

In the present embodiment, there is provided an auto-calibration process in which the first calibration process and the second calibration process are sequentially performed automatically.

Figure 12:
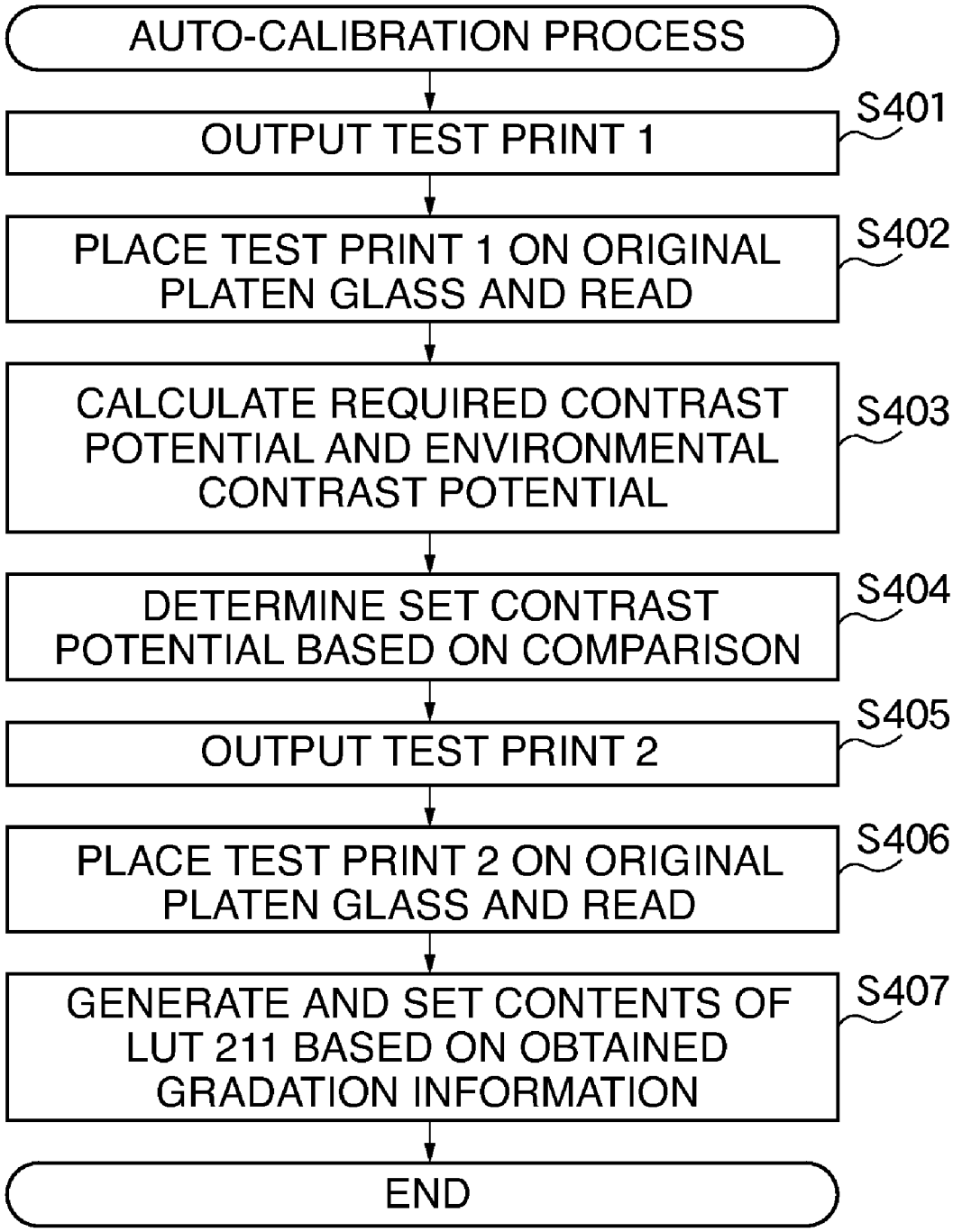
FIG. 12 is a flowchart of an auto-calibration process executed by the image forming apparatus.

FIG. 12 is a flowchart of the auto-calibration process executed by the image forming apparatus.

The present process is executed by the CPU 216 appearing in FIG. 2.

Referring to FIG. 12, the test print 1 is output (step S401) and read (step S402). Then, the required contrast potential and the environmental contrast potential are calculated (step S403).

The set contrast potential is determined based on the result of a comparison between the required contrast potential and the environmental contrast potential (step S404). Then, the test print 2 is output (step S405) and read (step S406). Based on gradation information obtained from the test print 2, the contents of the LUT 211 are created and set (step S407), followed by terminating the present process.

Figure 13:
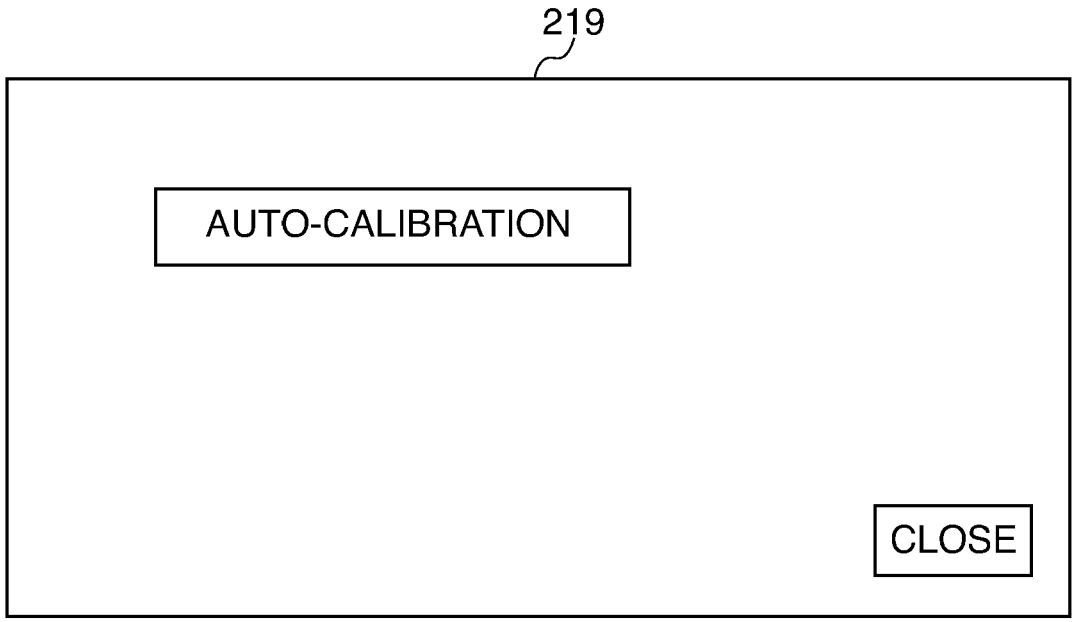
FIG. 13 is a view showing a screen displayed on an operating section appearing in FIG. 2 when executing the auto-calibration process.

FIG. 13 is a view showing a screen displayed on an operating section appearing in FIG. 2 when executing the auto-calibration process.

As shown in FIG. 13, an "auto-calibration" button is displayed on the screen of the operating section (operation panel) 219, and when the user presses the button, the above-mentioned auto-calibration process is executed.

According to the present embodiment, it is possible to effectively correct short-term or long-term and other various variations of image density, image reproducibility, and gradation reproducibility by carrying out the auto-calibration process, to thereby output optimal images.

In the following, a description will be given of a case where the parameter "d" used for contrast determination is configured to be variable.

The parameter "d" is a predetermined reference value of the ratio of the required contrast potential "b" to the environmental contrast potential "e" and is used as a parameter concerning the maximum amount of density correction by the LUT 211. Therefore, if the parameter "d" is set high, the maximum amount of density correction by the LUT 211 is reduced, which prevents reduction of the number of gradations, and hence it is possible to prevent degradation of gradation.

However, when the parameter "d" is high, it is less likely that contrast will be set in accordance with the environmental contrast potential. In this case, contrast is set lower, which causes degradation of image reproducibility.

In the present embodiment, reproducibility is regarded as the more important, and the parameter "d" is set to a value which makes it possible to maintain gradation characteristics at a minimum required level. However, it is also possible to variably set the parameter "d" via the operation panel.

In this case, since the user himself/herself is capable of keeping reproducibility and gradation in balance, it is possible to perform image forming condition control in a manner adapted to various needs.

It is to be understood that the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions This application claims priority from Japanese Patent Application No. 2007-102060 filed Apr. 9, 2007, which is hereby incorporated by reference herein in its entirety.

What is claimed is:

1. An image forming apparatus comprising:

a toner image forming unit configured to irradiate a photosensitive member with light to form an electrostatic latent image, and to develop the electrostatic latent image with toner to form a toner image;

a contrast potential determination unit configured to determine a contrast potential as a difference between a surface potential of the photosensitive member which is not irradiated and a surface potential of the photosensitive member which is irradiated;

a measuring image forming unit configured to form a density measuring toner image using the toner image forming unit;

a density measuring unit configured to measure a density of the density measuring toner image;

a first determination unit configured to determine a first contrast potential according to an environment condition of the image forming apparatus;

a second determination unit configured to determine a second contrast potential of forming a toner image, based on a difference between a target density and the measured density of the density measuring toner image; and a setting unit configured to set, after the second contrast potential has been determined, a contrast potential to be set in order for the toner image forming unit to form the toner image, to any one of the first contrast potential and a third contrast potential which is lower than the first contrast potential, according to a ratio of the second contrast potential to the first contrast potential, the first contrast potential and the third contrast potential varying according to the environment condition.

2. An image forming apparatus as claimed in claim 1, wherein the setting unit sets the contrast potential to be set in order for the toner image forming unit to form the toner image to the third contrast potential, after the second contrast potential has been determined in the case where the ratio of the second contrast potential to the first contrast potential is lower than a predetermined value.

3. An image forming apparatus as claimed in claim 1, wherein the third contrast potential is lower than the first contrast potential and not lower than the second contrast potential.

* * * * *